United States Patent [19]

Hoffmann

[11] 4,426,818

[45] Jan. 24, 1984

[54] HEAT-INSULATING PANEL

[75] Inventor: Benno Hoffmann, Ludwigshafen, Fed. Rep. of Germany

[73] Assignee: BASF Aktiengesellschaft, Ludwigshafen, Fed. Rep. of Germany

[21] Appl. No.: 204,636

[22] Filed: Nov. 6, 1980

[30] Foreign Application Priority Data

Dec. 17, 1979 [DE] Fed. Rep. of Germany ... 7935446[U]

[51] Int. Cl.[3] ..... E04B 1/62

[52] U.S. Cl. ..... 52/309.4; 52/593; 52/406

[58] Field of Search ..... 52/309.4, 593, 406, 52/407; 428/155, 167

[56] References Cited

U.S. PATENT DOCUMENTS

| | | | |
|---|---|---|---|
| 183,073 | 10/1876 | Setchell | 428/167 |
| 1,807,395 | 5/1931 | Ellis | 52/407 |
| 1,848,272 | 3/1932 | Powell | 52/407 |
| 2,860,768 | 11/1958 | Smithers | 428/167 |
| 3,353,315 | 11/1967 | Barker | 428/167 |

FOREIGN PATENT DOCUMENTS

| | | | |
|---|---|---|---|
| 245352 | 1/1961 | Australia | 52/309.4 |
| 2537604 | 2/1977 | Fed. Rep. of Germany . | |
| 2751112 | 5/1979 | Fed. Rep. of Germany . | |
| 153417 | 6/1932 | Switzerland | 52/593 |

*Primary Examiner*—James L. Ridgill, Jr.
*Attorney, Agent, or Firm*—Keil & Witherspoon

[57] ABSTRACT

Rectangular heat-insulating panels of a semi-rigid foam plastic, in particular a foam produced from polystyrene beads, are provided on both sides with a plurality of incisions which run at right angles to the principal plane of the panel and parallel to one end face. The four end faces each have matching tongue and groove profiles. The insulating panels may be used for the heat insulation of parts of buildings, especially of pitched roofs.

5 Claims, 3 Drawing Figures

HEAT-INSULATING PANEL

The present invention relates to a heat-insulating panel which consists of a foam plastic and is provided with incisions on both sides, whilst the end faces possess continues tongue and groove profiles.

Semi-rigid foam plastics, for example foam produced from polystyrene beads, are employed extensively for insulating buildings and parts thereof, especially roofs, against cold and heat. They inherently have a relatively high rigidity. Because of this, fitting panels of semi-rigid foam plastics as heat insulation between rafters is much more difficult and time-consuming than fitting a soft fibrous insulating material. Since the interval between rafters generally varies within a particular section of the roof, and also from section to section, as a result of inaccurate fitting of the rafters, and as a result of warping, each panel must be individually trimmed to shape.

Shrinkage or thermal contraction of the foam plastic panels, or changes in shape of the roof-bearing construction, can lead to cold bridges or to tearing of roofing felt.

German Utility Model No. 79/06,824 describes a panel-shaped molding of a semi-rigid foam plastic, which substantially eliminates the above disadvantages. The panel has a plurality of incisions, preferably on both sides, which run at right angles to the plane of the panel and parallel to one end face, the intervals between incisions being less than the panel thickness, and the depth of the incisions being greater than half the panel thickness.

As a result of this, the panels become deformable, at right angles to the plane of incision, by substantially lower forces and are substantially easier to fit into fixed apertures. Since not only the compressive rigidity but also the tensile rigidity at right angles to the plane of incision is reduced, very low holding forces suffice to prevent contraction of the panels, due to shrinkage or thermal contraction, at right angles to the plane of incision. This has the advantage, in practice, that cold bridges resulting from opened-up butt joints, and stress peaks in the covering layers are avoided.

On pitched roofs, the intervals between rafters vary widely, from about 55 to 75 cm. Accordingly, when fitting the above heat-insulating panels for roof insulation, several panel widths must be available. Since, however, it is not possible to provide an infinite range of panel widths, it is in most cases necessary in practice to trim the panels to match the actual interval. This causes loss of material when laying the panels and necessitates removing the scrap. On the one hand the panel manufacturer is forced to produce several types of panels with different widths, whilst the distributor has to keep an expensive stock. Both factors have an adverse effect on costs.

It is an object of the present invention to provide a heat-insulating panel which can be fitted independently of the interval between rafters, without substantial loss of material.

We have found that this object is achieved, according to the invention, if the end faces of the conventional incised panels are provided with tongue and groove profiles.

Accordingly, the invention relates to a rectangular heat-insulating panel of semi-rigid foam plastic of density from 10 to 100 g/l, which panel is from 2 to 20 cm thick and is provided on both sides with a plurality of incisions which run substantially at right angles to the principal plane of the panel and parallel to one end face, the intervals between incisions being less than the panel thickness, and the depth of the incisions being greater than half the panel thickness. According to the invention, this panel has matching tongue and groove profiles on the four end faces.

Semi-rigid foam plastics are, according to H. Götze, "Schaumkunststoffe", Strassenbau, Chemie and Technik Verlagsgesellschaft, Heidelberg, page 24, foams which under increasing compressive stress exhibit a progressive partially reversible deformation without reaching a defined state of collapse, as is the case, for example, with brittle hard foam plastics, which under increasing compressive stress fail through sudden collapse of the structure, without first having shown a significant elastic deformation.

Preferred foams are based on polystyrene and are in particular produced from polystyrene beads. Extruded polystyrene foam, polyvinyl chloride foam and semi-rigid polyurethane foam may also be used, as may in particular a resilient melamine/formaldehyde foam as described in German Patent Application No. P 29 15 457, or a resilient urea/formaldehyde foam.

The density of the foams is from 5 to 100 g/l, preferably from 10 to 50 g/l. The thickness of the foam panels may be from 2 to 20 cm, preferably from 5 to 15 cm and especially from 8 to 12 cm. The width of the panels is preferably from 40 to 200, especially from 50 to 80, cm and the length preferably from 40 to 1,000 and especially from 50 to 125 cm.

The incisions run substantially at right angles to the principal plane of the panel and parallel to one end face. Slight deviations from these directions, for example by up to 10°, are acceptable.

The intervals between incisions are less than the panel thickness, and the depth of the incisions is greater than half the panel thickness. The width of the incision slits depends on the type of tool used and may be from 0 to 3 mm, preferably from 0.2 to 2 mm; if the slits are broader than this, the insulating action of the panel suffers and cold bridges may form.

There are various methods for producing the incisions in the panels. Examples of suitable tools are saws, cutting rings, rotating knives, hot wires and oscillating wires.

The incisions are provided on both sides of the foam panel but must of course be staggered relative to one another. Preferably, the depth of incision is the same on both sides. Parallel incisions are preferred.

The tongue and groove profiles may be produced on the foam panels before or after the incisions. The profiles can be milled or cut in the foam by conventional methods. In principle, the shape and size of the profiles is optional, provided, of course, the tongue and groove match. The tongue and groove may have a rectangular or conically tapering cross-section but are preferably somewhat rounded to facilitate assembly.

The width of the groove is preferably about half the panel thickness and the depth should preferably be not less than 3 cm. It is advisable to select the overall dimensions of the panel, ie. including the tongue profiles, so that the foam blocks from which they are normally cut can be utilized to the optimum and scrap can be minimized.

The panel-shaped moldings according to the invention can, like conventional insulating materials, be laminated on one or both of the surfaces which are parallel to the principal plane of the panel. Suitable laminating materials are those which possess high tensile strength but bend easily, for example nonwovens or fabrics made from textiles or glass fibers, metal foils, plastic films or bitumen sealing webs. If the moldings are laminated on one side only, they can be rolled up as webs. In the fitted panel, the laminating material serves, depending on its nature, as a tensile reinforcement and/or water vapor barrier and/or draught seal or water seal. Lamination on both sides results in reinforcement on both sides, with the same additional functions as in single-sided lamination.

The heat-insulating panels according to the invention serve for the thermal insulation of sub-divided surfaces, especially of pitched roofs, the panels being introduced between the rafters. Fitting of the panels falls into two categories:

(a) the panel width is less than the interval between rafters and (b) the panel width is greater than the interval between rafters.

In case (a) the procedure followed is that two or more panels are joined together by tongue and groove joints at their end faces which run parallel to the rafters, the excess piece of panel is cut off to leave a panel assembly equal in width to the space between the rafters plus an allowance of from 0.5 to 5, preferably from 1 to 2, cm, and the cut-to-size panel assembly is compressed, crosswise to the rafters, by the amount of the above allowance and is thus introduced between the rafters; in the next step, the excess piece of panel cut off in the previous operation is assembled with another panel, or piece of panel, in the same manner, cut to size and introduced between the rafters.

In case (b), the procedure followed is that the excess piece of panel is cut off to leave a panel equal in width to the space between the rafters plus an allowance of from 0.5 to 5, preferably from 1 to 2, cm, and this trimmed panel is compressed, crosswise to the rafters, by the amount of the above allowance and is thus introduced between the rafters; in the next step, the excess piece of panel cut off in the previous operation is assembled with another panel, or piece of panel, in the same manner, cut to size and introduced between the rafters.

In both cases, the individual panels or panel assemblies introduced between the rafters are subsequently joined by bringing together their tongue and groove profiles running crosswise to the rafters.

By compressing the panels or panel assemblies, these are stressed crosswise to the rafters. As a result, they hold firm, unaided, between the rafters. They can, however, be additionally secured to the rafters by pinning or by fitting of laths. As a result of the tongue and groove joint between the individual panels or panel assemblies in the lengthwise direction to the rafters, an excellent fit, and impermeability to draughts, is achieved.

Using the fitting process described, there is virtually no less of material from scrap pieces, since the cut-off pieces of panel can be re-used, except for very small remnants. A further advantage of the novel heat-insulating panel is that the panel manufacturer can restrict himself to one width of panel. This permits streamlining of production. In addition, optimum utilization of the foam blocks is achieved if the panel dimensions are selected appropriately. Furthermore, packaging and transportation of the panels is simplified. For stockists, there is the advantage of greatly reduced and simplified stockholding. In using the heat-insulating system, there are advantages to both tradesmen and do-it-yourself workers, in respect of planning and purchasing, since the available panel width can be used regardless of the interval between rafters, and measuring the rafter intervals beforehand, so as to draw up a detailed list of required material, is unnecessary.

The drawings diagrammatically show a particularly preferred embodiment of the novel heat-insulating panel and two principles of fitting the panels.

Figure 1:
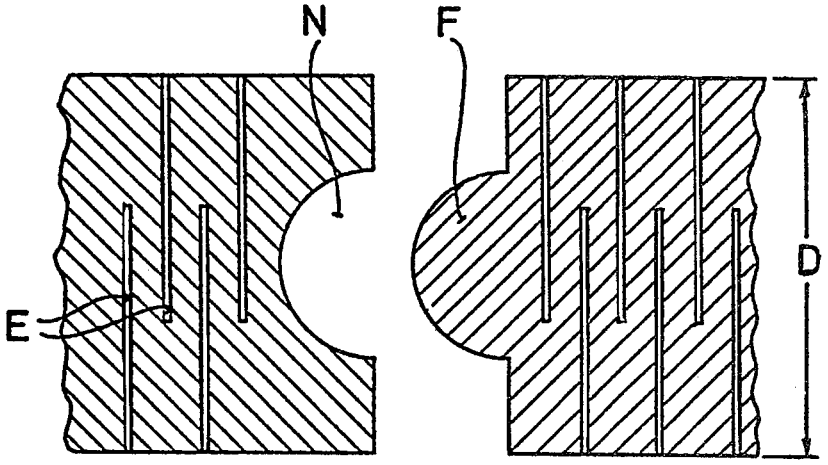
FIG. 1 shows a sectional view parallel to an end face of two heat-insulating panels which have a thickness D and possess a semi-circular groove N and tongue F, and incisions E.
Figure 2:
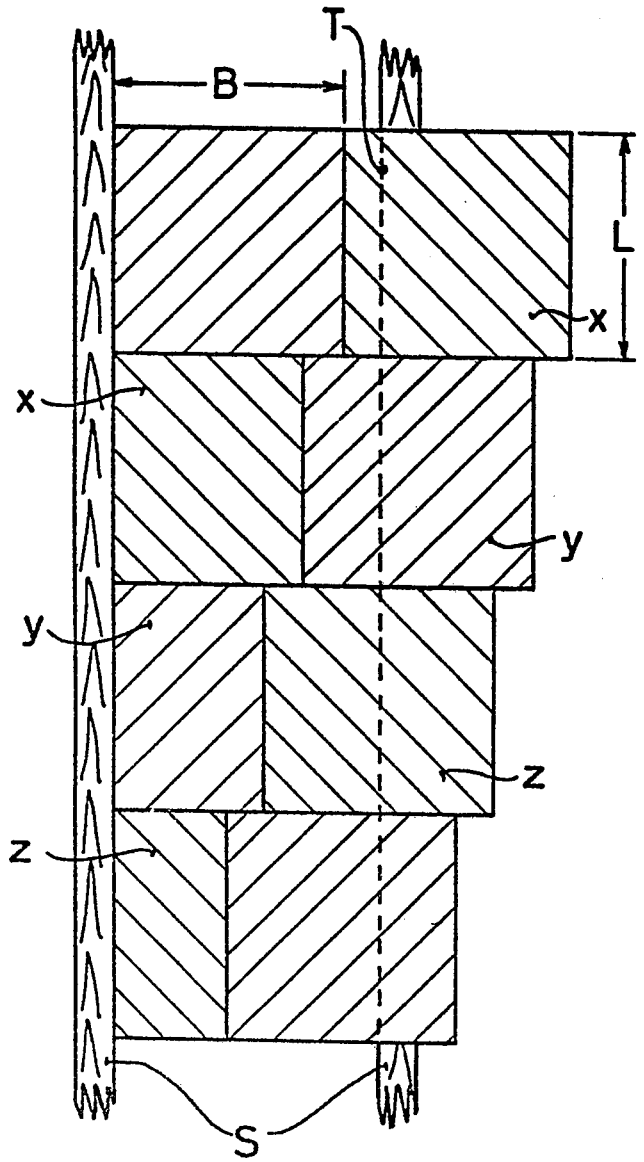
FIG. 2 shows category (a) of fitting the panels, where the panel width B (62.5 cm, including the tongue) is less than the interval between the two rafters S (75 cm)
Figure 3:
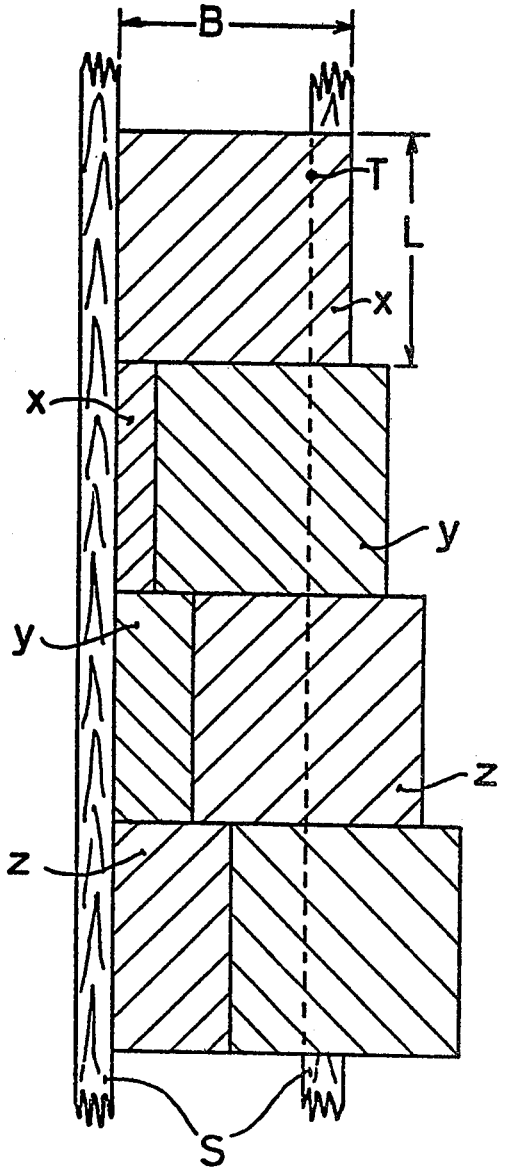
FIG. 3 shows category (b), where the panel width B is greater than the interval between the rafters (55 cm).

In both cases, the panels are of the same length L (100 cm, including the tongue) and of the same thickness (10 cm). The excess pieces of panel x, y and z are severed along the cutting line T and are each re-used in the next step of the fitting process. The allowance (1 cm) referred to above is not taken into account in the drawings. The dimensions shown in parentheses relate to a field trial.

I claim:

1. A modular assembly comprising a plurality of adjacent rows of rectangular heat-insulating panels of semi-rigid foam plastic, said rows being dimensioned for insertion, under endwise compression, between structural members, such as rafters, which extend lengthwise in parallel relationship to each other at varying mutual spacings, each said panel being provided, for compressibility, on both sides with a plurality of incisions which run substantially at right angles to the principal plane of the panel and parallel to the end faces thereof, and, hence, parallel to said members, the spacings between incisions being less than the panel thickness and the depth of the incisions being greater than half of the panel thickness, each said panel having at its end faces and at its side faces matching tongue and groove profiles which interlock the individual panels of said assembly both in the endwise direction and from row to row, and portions of said panels, which have been trimmed off, from one or the other end of said assembly, adjacent the corresponding member, for fitting said panels under compression endwise between said members, being at least partially reused in other rows of said assembly.

2. A modular assembly as claimed in claim 1, wherein said foam plastic has a density of from 5 to 100 g/l and each said panel has a thickness of from 2 to 20 cm.

3. A rectangular heat-insulating panel of semi-rigid foam plastic of a density of from 5 to 1000 g/l, for use in a modular assembly comprising a plurality of adjacent rows of said panels, said rows being dimensioned for insertion, under endwise compression, between structural members, such as rafters, which extend lengthwise in parallel relationship to each other and at varying mutual spacings, said panel being provided, for compressibility, on both sides with a plurality of incisions which run substantially at right angles to the principal plane of the panel and parallel to the end faces thereof, the spacings between incisions being less than the panel thickness and the depth of the incisions being greater than half of the panel thickness, and said panel element having at its end faces and at its side faces matching tongue and groove profiles which interlock the individual elements of said assembly both in the endwise direction and from row to row, such that portions of said panels, which have been trimmed off, from one or the other end of said assembly, adjacent the corresponding member, for fitting said panels under compression endwise between said members, are available for at least partial reuse in other rows of said assembly.

4. A heat-insulating panel as claimed in claim 3, which has a width of from 40 to 200 cm and a length of from 40 to 1,000 cm.

5. A heat-insulating panel as claimed in claim 3, wherein the tongue and groove profiles are rounded.

* * * * *